United States Patent [19]

Fischer et al.

[11] Patent Number: 4,744,920

[45] Date of Patent: May 17, 1988

[54] BORATED OVERBASED MATERIAL

[75] Inventors: Joseph P. Fischer, Willowick; Kirk E. Davis, Euclid; Jack L. Karn, Richmond Heights; John M. Cahoon, Mentor, all of Ohio

[73] Assignee: The Lubrizol Corporation, Wickliffe, Ohio

[21] Appl. No.: 945,754

[22] Filed: Dec. 22, 1986

[51] Int. Cl.[4] ..... C10M 135/10

[52] U.S. Cl. ..... 252/33.4; 252/18; 252/49.6

[58] Field of Search ..... 252/18, 33.4, 49.6

[56] References Cited

U.S. PATENT DOCUMENTS 4,597,880 7/1986 Eliades ..... 252/33.4

*Primary Examiner*—Jacqueline V. Howard

*Attorney, Agent, or Firm*—Joseph P. Fischer; Forrest L. Collins; Denis A. Polyn

[57] ABSTRACT

The present invention describes carbonated overbased products which have been borated. The products have a very small particle size.

32 Claims, No Drawings

BORATED OVERBASED MATERIAL

BACKGROUND OF THE INVENTION

Field of the Invention

This invention describes borated overbased materials which are useful in lubricating oils.

It has long been desirable to include boron in a suitable form in a lubricating oil such as for a motor vehicle. Borate salts are highly water soluble materials which tend to partition upon exposure to water, either in storage or in use. It is desirable to minimize such loss or inactivation of the boron in the product. Typically, the boron is incorporated as a portion of an organic molecule or associated with an organic molecule in an attempt to stabilize the borates against water.

The use of boron in a lubricant is to provide proper anti-oxidant, anti-rust, frictional characteristics and extreme pressure qualities to the lubricating oil. The boron typically functions by forming a barrier between moving metal parts through a chemical attraction to the surface of one or both of the metals. It is desirable that the boron be dispersed as much as is possible in the product to ensure that all of the metal surfaces which come in contact with the lubricating oil will be properly protected. This invention deals with the method of obtaining the boron in an organic molecule in extremely small particle sizes such that the boron is substantially distributed at all times throughout the lubricating oil.

It is known from U.S. Pat. No. 3,929,650 to King et al issued Dec. 30, 1975 that alkali metal borates may be prepared by contacting boric acid with an alkali metal carbonate overbased metal sulfonate within an oleophilic liquid reaction medium. It is also known from King et al in U.S. Pat. No. 3,907,691, issued Sept. 23, 1975 that mixed metal borates may be obtained by reacting boric acid with an alkaline earth metal carbonate overbased metal sulfonate in a lubricating oil or grease medium to form an intermediate and thereafter to react alkali metal base with the intermediate to form a mixed alkali and alkaline earth metal borate dispersion.

Hellmuth, in U.S. Pat. No. 3,679,584, issued July 25, 1972 describes a process for increasing the alkaline earth metal ratio of an alkaline earth metal carbonate overbased alkaline earth metal sulfonate lubricating oil composition by introducing into a lubricating oil medium containing a colloidal-like dispersion of an alkaline earth metal carbonate overbased alkaline earth metal sulfonate, an alkaline earth metal hydroxide, and boric acid and subsequently contacting the resultant mixture with carbon dioxide. In U.S. Pat. No. 3,846,313, issued Nov. 5, 1974 to Sims, it is disclosed that particulate hydrated alkali metal borate may be combined with an aliphatic hydrocarbon alcohol and to disperse this mixture in an oil of lubricating viscosity.

Adams, in U.S. Pat. No. 4,100,080, issued July 11, 1978 describes greases which contain organic grease thickeners and dispersions of finely divided borates as extreme-pressure agents. LeSuer in U.S. Pat. No. 3,829,381 issued Aug. 13, 1974, describes borated calcium overbased products.

It is therefore, desirable to obtain a very fine particle size organic source of boron which may be easily dispersed in a lubricating oil or grease. The product should also be formulated to contain a relatively high percentage of carbon dioxide to promote dispersibility of the organic boron source within the product.

The process for obtaining the product of the invention should be conducted such that the substantial foaming upon incorporation of the boron component is avoided. The product should also be obtained conveniently by avoiding alternatively raising and lowering the temperature during the reaction process.

The aforementioned goals are met by producing a product as described herein. Throughout the specification and claims, percentages and ratios are by weight, temperature are in degrees Celsius, and pressures are in KPa gauge unless otherwise indicated. To the extent that the references cited herein are applicable to the present invention, they are incorporated by reference herein.

SUMMARY OF THE INVENTION

This invention describes a process for obtaining a high carbonate content borated product comprising:

(a) mixing an overbased sulfonate and any required inert liquid medium, (b) borating the mixture (a) with a borating agent at a temperature less than that at which substantial foaming occurs, (c) raising the temperature of the mixture (b) to that temperature in excess of the boiling point of water within the mixture (b), (d) separating substantially all of the water from the reaction mixture (c) while retaining substantially all of the carbonate in the mixture (c) and, (e) recovering the product (d) as a high carbonate content borated product.

A process for obtaining a high carbonate content overbased borated product containing at least about 5% by weight of carbon dioxide wherein the product is obtained by:

(a) mixing an overbased component and any required inert liquid medium, (b) reacting component (a) in the presence of a borating agent to a boron content of at least about 3% by weight of the product, (c) reducing the water content of the product (b) to less than about 3% by weight and, (d) recovering the high carbonate content overbased borated product.

The products of the above processes as well as an overbased borated product having a mean particle diameter of less than about 9 microns is also described.

DETAILED DESCRIPTION OF THE INVENTION

A. The Overbased Material

The overbased components utilized herein are any of those materials typically utilized for lubricating oils or greases. The anion of the overbased component is typically a sulfonate, phenate, carboxylate, phosphate or similar material. Especially preferred herein are the anionic portions which are sulfonates. Typically the useful sulfonates will be mono-or di-hydrocarbyl substituted aromatic compounds. Such materials are typically obtained from the by-products of detergent manufacture. The products are conveniently mono- or di-sulfonated and the hydrocarbyl substituted portion of the aromatic compound are typically alkyls containing about 10 to 30, preferably about 14 to 28 carbon atoms.

The cationic portion of the overbased material is typically an alkali metal or alkaline earth metal. The commonly used alkali metals are lithium, potassium and sodium, with sodium being preferred. The alkaline earth metal components typically utilized are magnesium, calcium and barium with calcium and magnesium being the preferred materials.

The overbasing is accomplished utilizing an alkaline earth metal or alkali metal hydroxide. The overbasing is accomplished by utilizing typically any acid which may be bubbled through the component to be overbased. The preferred acidic material for overbasing the components of the present invention is carbon dioxide as it provides the source of carbonate in the product. As it has been noted that the present invention utilizes conventionally obtained overbased materials, no more is stated within this regard.

The preferred overbasing cation is sodium and the overall preferred product is a borated sodium carbonate overbased sodium sulfonate. A second preferred product herein is a borated sodium carbonate overbased calcium sulfonate.

The overbasing is generally done such that the metal ratio is from about 1.05:1 to about 50:1, preferably 2:1 to about 30:1 and most preferably from about 4:1 to about 25:1. The metal ratio is that ratio of metallic ions and an equivalent basis to the anionic portions of the overbased material.

B. The Inert Liquid Medium

The inert liquid medium when utilized to obtain the borated product facilitates mixing of the ingredients. That is, the overbased materials tend to be rather viscous especially when the alkaline earth metal components are utilized. Thus, the inert liquid medium serves to disperse the product and to facilitate mixing of the ingredients. The inert liquid medium is typically a material which boils at a temperature much greater than that of water and which is useful in the end product for which the invention is intended.

Typically, the inert liquid medium is a member selected from the group consisting of aromatics, aliphatics, alkanols and mineral oil and mixtures thereof. The aromatics utilized are typically benzene or toluene while the aliphatics are materials having from about 6 to about 600 carbon atoms. The alkanols may be mono- or di-alkanols and are preferably those materials which have limited water solubility. Typically, alkanols containing 10 or less carbon atoms are useful herein. Mineral oil, when used as the inert liquid medium is as typically defined by the ASTM standards.

The inert liquid medium may be omitted where, for example, the product is extruded. In such cases mechanical mixing replaces the need for a solvent.

C. The Carbon Dioxide Component

The carbon dioxide content of product (d) is typically greater than about 5% by weight. It is desirable that the carbon dioxide content of product (d) be between 5.5% and about 12% by weight. The weights given herein are by weight of the total product including the inert medium. The carbon dioxide content of the products is obtained by acidifying the product to liberate all of the $CO_2$ in the product. For purposes herein, the terms carbon dioxide and carbonate are identical. That is, the carbonate is the chemically incorporated form of the carbon dioxide and the latter is the compound used to specify the amount of carbonate in the product. Thus, the ratios expressed herein use the molecular weight (44) of carbon dioxide.

D. The boronating agent is conveniently orthoboric acid. Also useful herein are boron halides such as boron trifluoride, polymers of boric acid, boron anhydride, boron esters and similar materials. The boron content of the products of the present invention is typically greater than 3%, preferably greater than 4% and most preferably greater than 5% by weight of the product. It is also desirable that the weight percent of carbon dioxide in the product (d) is at least 50% by weight of the boron in product (d). Preferably, the percent carbon dioxide to the percent boron is greater than 75% and most preferably greater than 100% by weight of the boron.

E. The water content of the product when it is finished is typically less than 3% by weight. At levels much greater than 2% by weight substantial amounts of the boron can be lost by forming boron compounds which are soluble in the water and which are separated off. If the separation does not occur during processing, then during storage, the boron content may be diminished by having unacceptably high levels of water in the product. More preferably, the water content of the product is less than 1% by weight and most preferably less than 0.75% by weight.

F. The Processing

The products herein are conventionally obtained up to the point where the boron incorporation occurs. That is, the boronation aspect to obtain the alkali metal or alkaline earth metal overbased sulfonate is downstream from the carbonation facility. If desired, carbonation may continue; however, such is not necessary and hinders the boronation in addition to raising the cost of the product.

The mixture (a) as defined in the Summary of the Invention is treated at (b) at a temperature less than that at which substantial foaming occurs. Such temperature is typically less than 110° C., more preferably less than 99° C., and most preferably between about 66° C. and about 88° C. It is also desirable that the temperature is raised during the boronation but not raised so rapidly as to cause substantial foaming. Not only does the foaming cause a loss of head space in the reaction vessel with a concomitant blocking of reaction ports but the product is not believed to be the same if it is rapidly liberated of carbon dioxide. That is, there is an exchange reaction occurring between the carbon dioxide portion of the overbased material and the boronating agent wherein boron polymers are incorporated into the overbased material. Thus, the boronation is allowed to occur without substantial foaming until the point where substantially no more boron is taken up by the overbased material.

At the point where the boron is substantially chemically incorporated within the overbased material, the temperature is then raised to a point in excess of the boiling point of water within the mixture (b). Such temperatures are typically in excess of 100° C. as the water tends to separate rapidly from the reaction mass at that temperature. Conveniently, the temperature for removing the water is between about 120° C. and 180° C. As the boronation is substantially complete and the carbon dioxide content of the product is stable, substantial foaming is avoided at the point where the water is taken from the product. Thus, little carbon dioxide will be liberated between steps (c) and (d). The temperature conditions are typcially not lowered substantially during steps (c) and/or (d), especially during (c).

The product is typically recovered as the high carbonate content borated product by allowing the product to cool, followed by suitable packaging. Of course, the product is slightly hygroscopic due to the high inorganic content and, thus, protective packaging is recommended. The product (d) may also be recovered by transferring it for downstream processing such as mixing it with additional materials such as an oil of lubricating viscosity or other desired components for a lubricant or a grease. A significant advantage in practicing the present invention is that the boronation is brought about without alternatively raising and lowering the temperature, especially during segmental addition of the boronating agent.

It is desired that the mean particle diameter of the products obtained herein is less than 9 microns, preferably less than 8 microns and most preferably less than 5 microns. Preferably, the particle size distribution is such that substantially all of the particles are less than 9 microns, more preferably less than 8 microns and most preferably less than 5 microns. Thus, the products obtained herein are substantially different than those known in the art in that the fine particle size obtained herein allows effective dispersion in an oil or grease thereby giving effective protection for the metal surfaces with which the product is brought into contact. General guidance in determining the particle size herein is found in the *Textbook of Polymer Science* by Billmeyer, fourth printing, March, 1966, Library of Congress Catalog Card No. 62-18350.

The following are suggested examples of the present invention.

EXAMPLE I

A sodium carbonate overbased (20:1 equivalent) sodium sulfonate is mixed with a diluent oil in a suitable reaction vessel. The diluent oil is mineral oil. The mixture of the sodium carbonate overbased sodium sulfonate and the diluent oil are heated to 75° C. Boric acid is then added slowly without substantially changing the temperature of the mixture.

The reaction mixture is then slowly heated to 100° C. over a period of about 1 hour while removing substantially all of the distillate. The carbon dioxide is observed to be removed without substantial foaming. The product is then further heated to 150° C. for about 3 hours while removing all of the distillate. It is observed that at the latter temperature, substantially all of the water is removed and very little of the carbon dioxide is evolved from the product. The product is then held for another hour at 150° C. until the water content of the product is less than about 0.3%.

The product is recovered by allowing it to cool to 100° C.–120° C. followed by filtration. The recovered filtrate of high clarity is the product.

EXAMPLE II

A charge of 800 parts of toluene and 400 parts of boric acid are added to a reaction vessel. The charge is heated to 85° C. and 1600 parts of a magnesium carbonate overbased magnesium sulfonate (15:1 metal to sulfonate equivalent ratio) are added. The temperature is observed to drop to 70° C. due to the addition of the cooler component. The temperature is then raised to 102° C. and held for three hours. The water is removed by azeotroping at the toluene reflux. The product is then stripped at 160° C. to remove the toluene. The product has a magnesium content of 7.35% out of a theoretical 8.73%, a boron content of 3.94% out of 4.2% theory, and a total base number of 369 out of 376.

EXAMPLE III

A charge of 800 parts of toluene and 400 parts of boric acid are added to a reaction vessel. The contents are heated to 60° C. and 1600 parts of a calcium carbonate overbased calcium sulfonate (20:1 equivalent ratio) are added and the resulting mixture is heated to 88° C. and held for 2 hours. An optional ingredient, polyisobutenyl succinic anhydride at 100 parts, is then added. The product is then obtained as in Example II. The calcium content is 13%, the boron is 3.15% and the total base number is 349. The theory figures are 13.3%, 3.83% and 343, respectively.

Substantially similar results are obtianed when a sodium carbonate overbased calcium sulfonate is employed.

We claim:

1. A process for obtaining a high carbonate content borated product comprising:

(a) mixing a carbonate overbased sulfonate, (b) borating the mixture (a) with a borating agent at a temperature less than that at which substantial foaming occurs thereby substantially retaining the carbonate in the mixture, (c) raising the temperature of the mixture (b) to that temperture in excess of the boiling point of water within the mixture (b), (d) separating substantially all of the water from the reaction mixture (c) while retaining substantially all of the carbonate in the mixture (c) and, (e) recovering the product (d) as a high carbonate content borated product.

2. The process of claim 1 wherein the sulfonate is overbased at a metal to sulfonate ratio of about 1.05:1 to about 50:1.

3. The process of claim 1 wherein the overbased sulfonate is an overbased sodium sulfonate.

4. The process of claim 1 wherein the carbonate content of the product (d) is greater than about 5% by weight.

5. The process of claim 1 wherein the carbonate content in the product (d) is at least 50% weight percent of the boron in product (d).

6. The process of claim 1 wherein the overbased sulfonate is a sodium overbased calcium sulfonate.

7. The process of claim 1 wherein substantially all of the particles are less than 9 microns.

8. The process of claim 1 wherein the inert liquid medium is selected from the group consisting of aromatics, aliphatics, alkanols and mineral oils and mixtures thereof.

9. The process of claim 1 wherein the carbonate content of product (d) is between about 5.5% and 12% by weight.

10. The process of claim 3 wherein the sodium sulfonate is a sodium carbonate overbased sodium sulfonate.

11. The process of claim 1 wherein the temperature is not substantially lowered during steps (c) and/or (d).

12. A process for obtaining a high carbonate content overbased borated product containing at least about 5% by weight of carbon dioxide wherein the product is obatined by:

(a) mixing a carbonate overbased component, (b) reacting component (a) in the presence of a borating agent to a boron content of at least about 3% by weight of the product, (c) reducing the water content of the product (b) to less than about 3% by weight and, (d) recovering the high carbonate content overbased borated product.

13. The process of claim 12 wherein the overbased component of (a) is a sulfonate.

14. The process of claim 12 wherein the water content of the product (b) is less than about 2.0% by weight.

15. The process of claim 12 wherein the inert liquid medium is selected from the group consisting of aromatics, aliphatics, alkanols and mineral oil and mixtures thereof.

16. The process of claim 12 wherein the overbased product is a sodium carbonate overbased product.

17. The process of claim 12 wherein substantially all of the particles of the overbased product are less than about 9 microns.

18. The process of claim 12 wherein the carbonate content is between about 5.5% and about 12% by weight.

19. The process of claim 12 wherein the water content of product (b) is reduced at a temperature of about 100° C. to about 200° C.

20. The process of claim 12 wherein the temperature is not substantially lowered during steps (c) and/or (d).

21. The product obtained from the process of claim 1.

22. The product obtained from the process of claim 12.

23. An overbased borated product having a mean particle diameter of less than about 9 microns.

24. The product of claim 23 wherein the overbased product is a sodium overbased product.

25. The product of claim 23 wherein the overbased product is a calcium sulfonate.

26. The product of claim 23 wherein the carbonate content of the product is at least about 5% by weight.

27. The product of claim 23 which is a sodium carbonate overbased calcium sulfonate.

28. The product of claim 23 and a liquid medium.

29. The product of claim 23 wherein the mean particle diameter is less than about 5 microns.

30. The product of claim 23 which is a sodium carbonate overbased sodium sulfonate.

31. The process of claim 1 additionally containing an inert medium at (a).

32. The process of claim 12 additionally containing an inert medium at (a).

* * * * *